US006532348B2

(12) United States Patent
Allmendinger

(10) Patent No.: US 6,532,348 B2
(45) Date of Patent: Mar. 11, 2003

(54) METHOD AND DEVICE FOR GENERATING AND ADJUSTING TEMPERATURE VALUES IN A FIXING ROLLER OF A TONER IMAGE FIXING UNIT

(75) Inventor: Franz Allmendinger, Aichwald (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/850,451

(22) Filed: May 7, 2001

(65) Prior Publication Data

US 2002/0076229 A1 Jun. 20, 2002

(30) Foreign Application Priority Data

May 18, 2000 (DE) ..... 100 24 134

(51) Int. Cl.[7] ..... G03G 15/20
(52) U.S. Cl. ..... 399/69
(58) Field of Search ..... 399/67, 69, 91, 399/320, 324, 325, 328, 330, 331

(56) References Cited

U.S. PATENT DOCUMENTS 5,550,621 A 8/1996 Ogawahara ..... 399/69
5,634,176 A * 5/1997 Ayash et al. ..... 399/91
5,752,147 A * 5/1998 in't Zandt ..... 399/325
5,787,321 A * 7/1998 Nishikawa et al. ..... 399/69
5,987,295 A 11/1999 Matsuo et al. ..... 399/330
6,064,850 A 5/2000 Matsuo et al. ..... 399/333

FOREIGN PATENT DOCUMENTS

DE 199 54 952 A1 5/2000

* cited by examiner

*Primary Examiner*—Hoan Tran
(74) *Attorney, Agent, or Firm*—Lawrence P. Kessler

(57) ABSTRACT

Generating and adjusting temperature values (T1, T2, T3) in a fixing roller (FR), which is mounted in a copy machine, can be switched to various operational states (W, A, and F) and can be used for fixing of toner images transferred on imaging materials (P). The fixing roller can be heated by a heating unit (H1) connected to a control/adjustment unit (CU), can be switched to generate and adjust predetermined temperature values (T1, T2, T3), and its heating level (Ph) can be regulated. The temperature values (T1, T2, T3) at the outer surface (FS) can be measured by at least one temperature sensor (ST). The outer surface of the fixing roller can be cooled by blowing airflow (AJ, AJ1–3) supplied by a controllable cooling unit (CO). The cooling unit (CO) creates a cooling strip (CA, CA1–3) on the outer surface of the fixing roller, and the blowing air level (Pc) can be controlled and adjusted by a control/adjustment unit acting upon the compressed air source (BL, AS).

11 Claims, 6 Drawing Sheets

METHOD AND DEVICE FOR GENERATING AND ADJUSTING TEMPERATURE VALUES IN A FIXING ROLLER OF A TONER IMAGE FIXING UNIT

FIELD OF THE INVENTION

The invention pertains to generating and adjusting temperature values in a fixing roller of a fixing unit, which is mounted in a copy machine, can be switched over to various operational states, and can be used for fixing of toner images transferred on imaging materials.

BACKGROUND OF THE INVENTION

There are some known fixing units which are used in copy machines, whereby the rotating fixing roller along with a pressing roller that can be mounted to its outer surface parallel with the axis form an opening, through which the imaging materials that carry the toner image could pass. The fixing roller can be heated by a heating agent connected to a control/adjustment unit whose heating level can be set up at different levels for generating and adjusting predetermined temperature values. The temperature values at the outer surface of the fixing roller can be registered by at least one temperature sensor; and the outer surface of the fixing roller can be cooled out by an airflow blowing unit fed from a controllable cooling unit.

A U.S. Pat. No. 5,787,321 patent discloses a device for generating and adjusting an operational or fixer temperature value at the outer circumference of heated and revolving fixing rollers of a fixing unit. The fixing rollers are arranged as a pair of rollers parallel with the axis and this pair consists of a heating roller and a pressing roller. A number of temperature sensors along with airflow blowing units assigned to them are arranged axially along both fixing rollers and are positioned axially at a distance from one another and in front of the fixing rollers in the direction of the flow, whereby the axial cross-section width of an airflow blowing unit, or to be more precise—its aired area, corresponds to the smallest width of the sheet carrying the toner image. In order to prevent an overheating of the top surfaces of the uncovered fixing rollers, which are not protected by the sheet running through the fixing opening, airflow blowing units are turned on and pointed towards it or them by a control unit, whereby the airflow blowing units are arranged in the so called sheet-free area of the fixing rollers. The generation and adjustment of temperature values, and especially the temperature of the fixer, as well as the switching over to the different operational states is done essentially by a heating level control/adjustment unit.

A disadvantage of the disclosed form of implementation is that a focused, homogeneous, and intensive cooling over the whole axial length of the fixing rollers by using the described airflow blowing units with a large opening for the flow can not be adequately achieved. Furthermore, due to the arrangement of the temperature sensors in the airflow, it is difficult to achieve an exact measurement of the temperature values at the outer surface of the fixing rollers. Also, due to its sluggishness, the used method of control/adjustment of the heating level is disadvantageous from the point of view of achieving fast generation, adjustment, and change of the temperature values, and particularly of the fixer temperature, as well as faster switching over to different operational states.

A DE-25 07 559-A patent discloses a device and a method For generating an operational or fixer temperature value at the outer circumference of heated and revolving fixing rollers of a fixing unit, whereby a heating roller and a pressing roller together form a pair of fixing rollers. A sucking unit for cooling the surfaces of both rollers is mounted at the top of the pressing roller. The sucking unit exhibits an airflow directing channels, which is aligned with the conveyor belt for transportation of the sheet and respectively axially aligned with the pressing roller. On the one hand, the airflow directing channel is connected through a single switching valve with a low-pressure generating unit, and, on the other hand, it has on both sides of the air channel a number of narrow air channels/air-pipes, which are parallel to each other, extend themselves axially up to both ends of the pressure roller, and lead into the air channel. The air pipes, which are positioned radially with respect to the surface of the pressing roller and at a distance from one another, are arranged in the direction of the pressing roller and along the outer circumference one behind the other at an angular interval of about 5–10 degrees. Each one of the air pipes has in its pipe wall a number of air nozzles, which are arranged one next to the other along the axial extension of the pipes and are lined up in such a way on the pressing roller that—in order to prevent overheating only the end areas, respectively the ends of the roller pairs that jut over the sheet width, are cooled. The generation and adjustment of the temperature values, and particularly the fixer temperature, as well as the switching over to the different operational states are performed essentially by a heating level control/adjustment unit.

A disadvantage of the disclosed form of implementation is that due to the use of the described sucking unit, which is mounted in the area of the pressing roller and whose cooling action is limited essentially to the axial end areas of the rollers, a focused, homogeneous, and intensive cooling over the whole axial length of the fixing rollers is not possible. Further disadvantage is that the air pipes cannot be separately controlled in order to vary the cooling action. Furthermore, due to its sluggishness, the used method of control/adjustment of the heating level is disadvantageous from the point of view of achieving fast generation, adjustment, and change of the temperature values, and particularly of the fixer temperature, as well as faster switching over to different operational states.

SUMMARY OF THE INVENTION

Therefore, a fundamental objective of the present invention is to provide a method and a device that does not have the above mentioned disadvantages and, what is more, guarantees the faster, more precise and simpler functioning of the fixing unit, and particularly a faster and more precise generation and adjustment of predetermined temperature values at the fixing roller in various operational states in order to accelerate and improve the fixing process in automated environment.

In the presented invention, this task is solved in such a way that the generation and adjustment of predetermined values at the outer surface of the fixing rollers is achieved by a controllable and adjustable airflow of the cooling unit; and also the generation and adjustment of the airflow is effected on the basis of a determined core temperature of the fixing roller.

Furthermore, this method can be advantageously characterized by the fact that an initial predetermined temperature value of the fixing roller can be generated and adjusted by a heating unit brought to a constant maximum heating level, and after the initial predetermined temperature value has been reached, a first and a second operational level of the fixing unit can be reached through the airflow of the cooling unit driven by small to middle (0 to 50%) airflow levels; that a second predetermined lower temperature value of the fixing roller at constant maximum heating level can be generated and adjusted in a third operational state of the fixing unit achieved by an airflow through maximal (100%) to middle (50%) airflow levels; and that between the start of the second operational state "Request for a fixing task", proceeding from the first operational state "Wait", and a transition to the third operational state "Fixing" there is a time interval whose length depends on the operational mode of the fixing unit before the request for a fixing task, and particularly on the core temperature of the fixing roller and the type of the imaging material that carries the toner image.

According to the invention, this task is solved by a cooling unit that has a blowing air unit in the form of a pipe connected to a source of compressed air. The pipe is mounted axially parallel to the fixing roller and is radially positioned in a fixed manner and at a distance from its outer surface, permitting it to generate a cooling strip at the outer surface of the fixing roller by a focused and concentrated compressed airflow whose air level can be controlled and adjusted through a control/adjustment unit acting upon the source of compressed air.

In advantageous way, based on the supported direction of the imaging medium carrying the toner image, the blowing part of the cooling unit is mounted in the direction of the airflow towards the fixing opening and at a distance from this opening in an area of the fixing roller. The blowing unit shows in its pipe wall at least one air nozzle in the form of a slot, which expands along its axial extent, or a number of air nozzles which are arranged along its axial extent, with the purpose of generation of concentrated and focused compressed airflow, which permits to create a cooling strip that extends itself over the whole axial length of the outer surface of the fixing roller. The obtained width of the whole cooling strip, which is formed by the separate cooling strips of the compressed air blowing unit, is essentially equal or less than one-fourth of the outer surface of the fixing roller.

BRIEF DESCRIPTION OF THE DRAWINGS

Further characteristics and advantages are available from the description of the examples of implementations of the invention, shown in the accompanying drawings in which.

DETAILED DESCRIPTION OF THE INVENTION

The following description, according to FIG. 1 through FIG. 5, reflects a preferred form of implementation of the present invention of generating and adjusting the temperature values of a rotating fixing roller of a fixing unit mounted in a copy machine and used for fixing of toner images transmitted by imaging medium. The invention is associated with the fixing unit of a duplicating machine of any well know kind, e.g. copy machine. For one of ordinary skill working in this specialized field, it is obvious that this invention can be used also in the fixing units of other machines, e.g. in printers.

Figure 1:
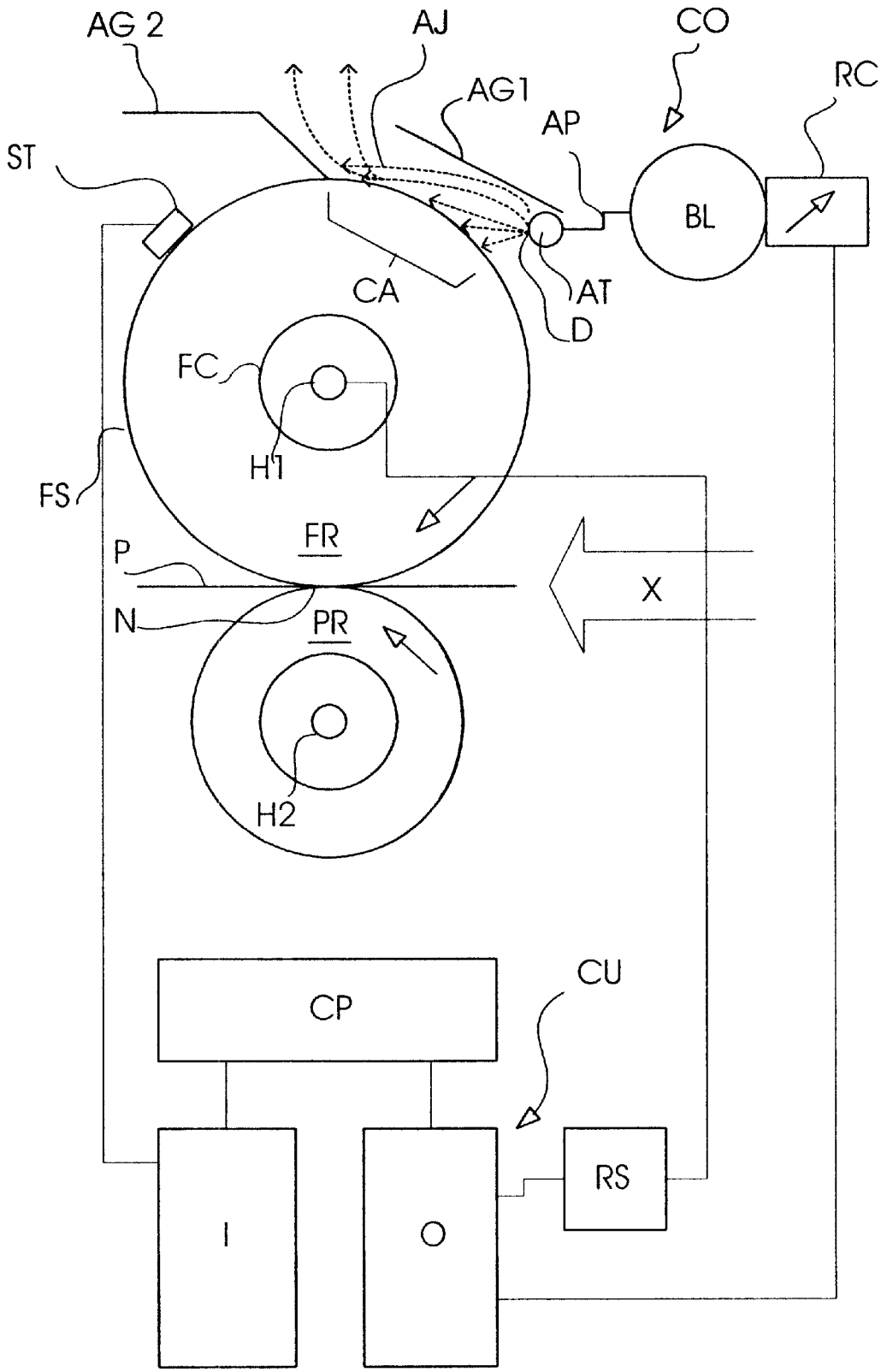
FIG. 1 is a schematic view of the device with a fixing unit, implemented according to the invention, seen in a lateral cross-section in axial direction to the fixing roller.
Figure 2:
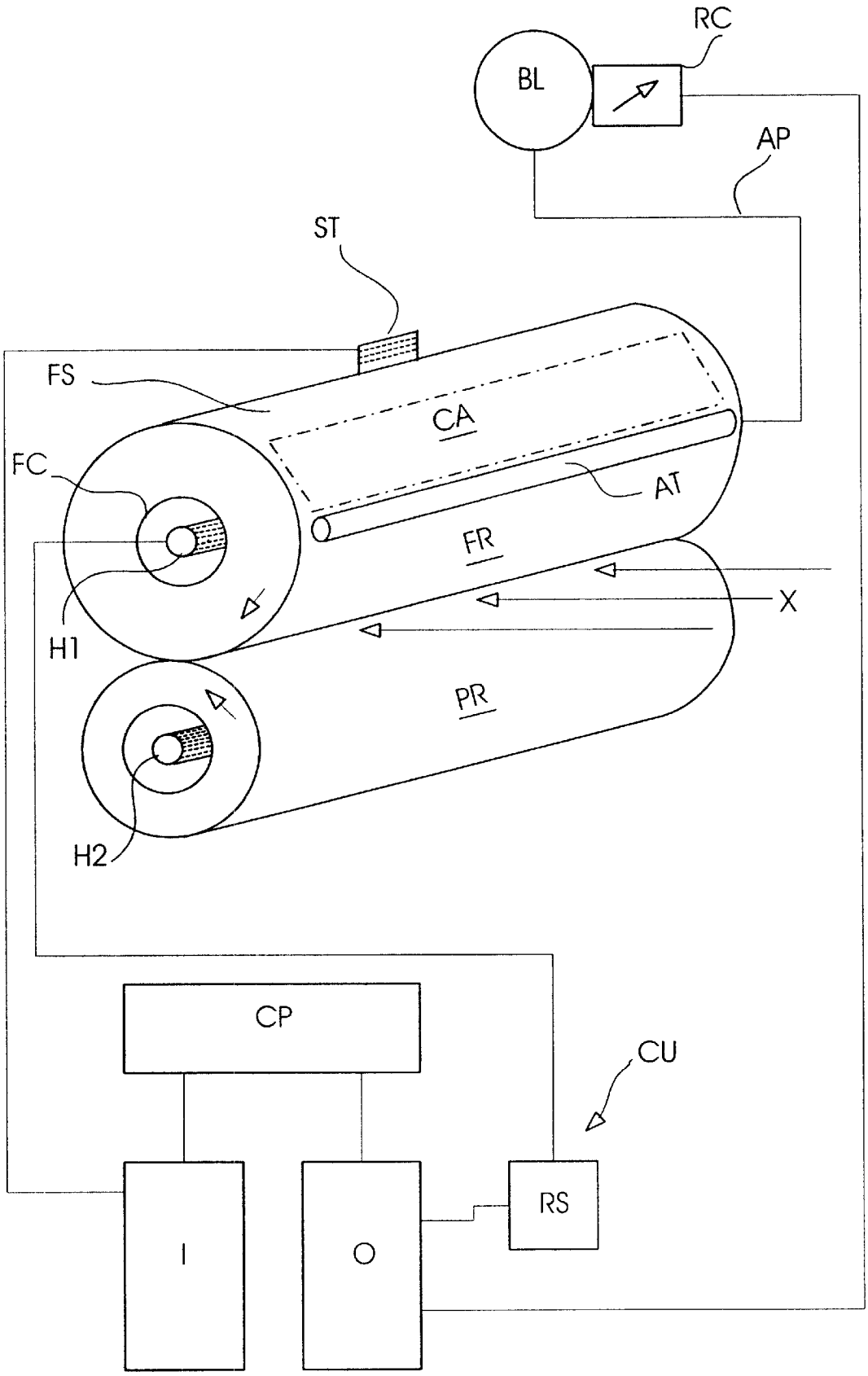
FIG. 2 shows the device from FIG. 1, implemented according to the invention, in 3-dimensional view.

The device for generation and adjustment of temperature values Ts, T1, T2, and T3, which is implemented according to the invention and is shown in schematic view in FIG. 1 and FIG. 2, is mounted on the fixing roller FR of a fixing unit. The fixing unit can be switched to different operational states W, A, and F and used for fixing of toner images carried by imaging material P. The unit is mounted into a traditional copy machine, which is not shown. The hollow fixing roller FR, which can be brought to rotation by an engine that is not shown, forms a fixing nip N in the fixing unit with a pressing roller PR that can be rotated and is mounted axially parallel to its outer surface FS. The fixing nip N receives imaging material (for example in the form of paper sheets or foil sheets) carrying a toner image through it in the shown direction of transportation X, whereby the imaging material carrying the toner image can be fused.

The fixing roller FR can be heated by a heating unit H1, for example a heating lamp, which is mounted centrally in the rotational axis of the hollow inner section of the roller. The heating unit H1 is electrically connected/coupled to a control/adjustment unit CU via the semiconductor relay RS of the output switching circuit O of a microprocessor unit CP. In this way, the heating unit H1 can be switched on to its heating level Ph and set up for generation and adjustment of the predetermined temperature values Ts, T1, T2, and T3 by the control/adjustment unit CU and the semiconductor relay RS.

The outer surface FS of the fixing roller FR can be cooled by an airflow fed by a cooling unit, which is controlled by the control/adjustment unit CU. The cooling unit CO has a pipe-formed airflow blowing unit AT connected to a compressed air source BL. The blowing unit AT is stationary mounted axially parallel to the fixing roller FR and radially positioned at a distance from its outer surface FS. A focused and concentrated compressed airflow AJ for creating a cooling strip CA on the outer surface of the fixing roller, can be generated by the blowing unit AT, and its airflow level Pc can be controlled and adjusted by a control/adjustment unit CU, which controls the compressed air source BL. The generation of the focused and concentrated and respectively spatially limited airflow, respectively cooling strip, is supported by one first air conducting element AG1 in the form of a sheet, which is mounted on the air blowing unit, and a second air conducting element AG2 in the form of a sheet mounted above the fixing roller.

With respect to the feeding direction X of the imaging material carrying the toner image, the blowing air unit AT of the cooling unit CO is mounted at a distance from this fixing nip in the direction of the airflow at the fixing nip N in an area of the fixing roller FR.

The temperature values Ts, T1, T2, and T3 can be registered at the outer surface FS of the fixing roller FR by a temperature sensor ST, which is electrically connected/coupled to the control/adjustment unit CU via an input switching circuit I. Furthermore, for the registration of the temperature values Ts, T1, T2, and T3 at the outer surface FS of the turning fixing roller FR, the temperature sensor ST is mounted in the opposite direction of the airflow between the blowing air unit AT and the fixing nip N and is in contact with the outer surface FS of the fixing roller FR. In an alternative form of implementation of the device, not shown here, according to the invention, there are several temperature sensors mounted, whereby the temperature sensor(s) ST is/are positioned radially at a distance from the outer surface and the temperature values of the fixing roller are registered in a contactless manner.

As shown in FIG. 2, the blowing unit AT is in the form of a cylindrical pipe with a circular cross-section profile whose first axial end is hermetically closed and its other end is connected to the compressed air source BL. The blowing unit AT has in its pipe wall at least one air nozzle D in the form of a slot extended along its axial length. The air nozzle D is used for generation of a concentrated and focused blowing airflow AJ by which a cooling strip CA extended over the total axial length of the fixing roller and with a predetermined width can be created on the outer surface FS of the fixing roller FR.

The air nozzle D of the blowing unit AT has along the axial length of the fixing roller FR predetermined different diameters, forms, or different distances from each other (not shown) in such a way that an inhomogeneous warming of the fixing roller along its axial length can be prevented by a predetermined compensatory cooling, e.g. when the width of the sheet is less than the axial length of the fixing roller. The width of the cooling strip CA formed by the airflow of the blowing unit of the cooling unit CO is substantially equal to or less than one-fourth of the outer circumference FS of the fixing roller FR.

As shown in FIG. 1 and FIG. 2, the compressed air source of the cooling unit CO is a motor-driven ventilator. The blowing unit AT is connected to the ventilator with an air channel AP. The blowing airflow AJ of the blowing unit can be controlled and adjusted by changing the number of revolutions of the ventilator motor, which is done by the control/adjustment unit CU and another unit connected to its output circuit O and used for setting up the number of revolutions of the motor. Furthermore, the cooling unit CO has at its blowing unit AT a blowing airflow AJ with air over-pressure equal to or less than 1.5 bar and airflow level equal to or less than 16 liter/sec.

Figure 3:
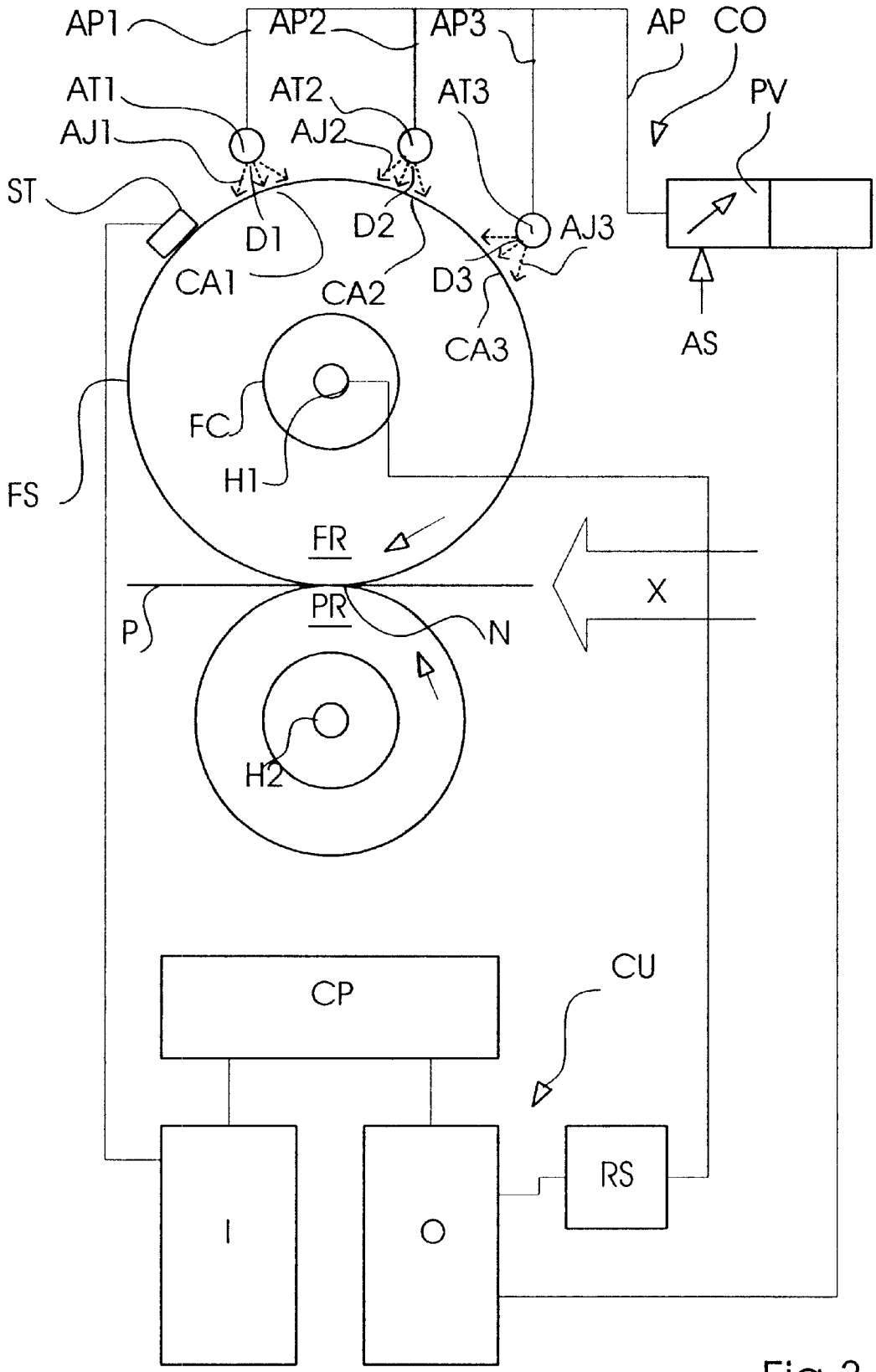
FIG. 3 shows the device from FIG. 1, implemented according to the invention, in an alternative form of implementation.

In an alternative form of the device, according to the invention, as shown in FIG. 3, the cooling unit CO has three blowing units AT1, AT2, and AT3 arranged one behind the other in the direction of rotation of the fixing roller FR. The three blowing units are mounted parallel to each other and in a concentric manner with respect to the fixing roller; and also, the three blowing units AT1, AT2, and AT3 are arranged in the direction of rotation at such an angular distance to each other that the cooling strips CA1, CA2, and CA3 generated by the blowing airflows AJ1, AJ2, and AJ3 on the outer surface FS of the fixing roller FR are either at a distance from each other or are in contact among each other.

Furthermore, the blowing units AT1, AT2, and AT3 have respective air nozzles D1, D2, and D3 for generation of concentrated and focused blowing airflows (not shown) positioned along their axial length, by which on the outer surface FS of the fixing roller FR three cooling strips CA1, CA2, and CA3 with predetermined width can be generated, which extend over the whole axial length of the fixing roller. The resulting width of the whole cooling strip obtained from the three separate cooling strips CA1, CA2, and CA3 of the blowing units AT1, AT2, and AT3 is substantially equal to or less than one-fourth of the outer surface FS of the fixing roller FR. In this alternative implementation, the compressed air source of the cooling unit CO is a conventional, well known compressed-air compressor AS, which is not shown. The blowing air units AT1, AT2, and AT3 are connected via a controllable air valve PV to the compressed-air compressor AS and can be controlled separately or together as one by the control/adjustment unit CU for control and adjustment of the blowing airflows AJ1, AJ2, and AJ3.

Figure 4A:
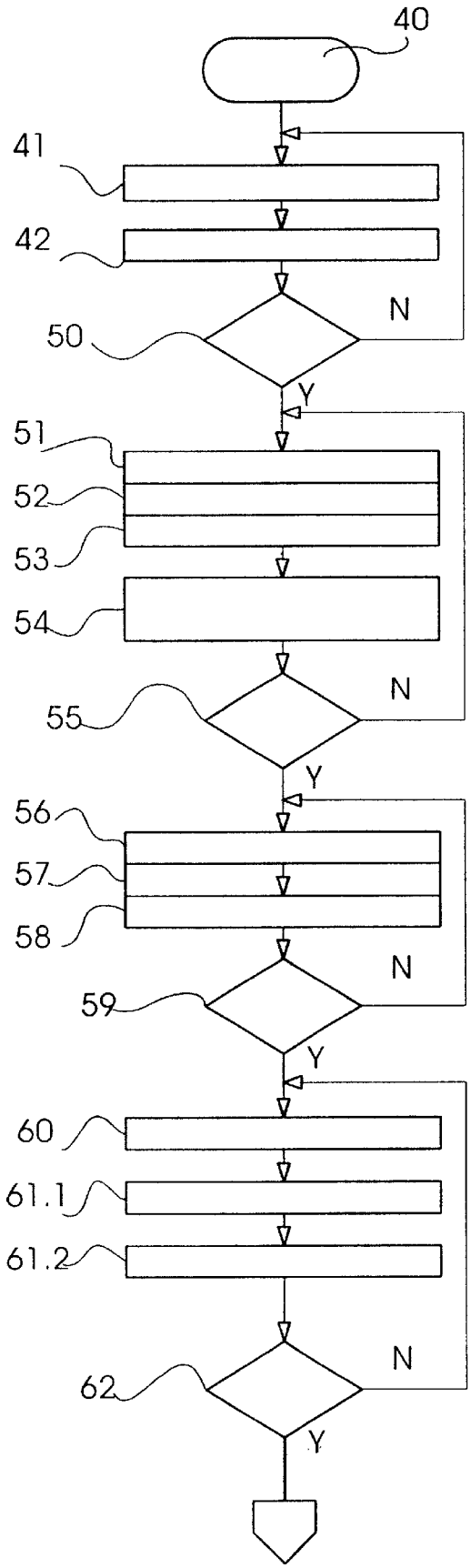
FIG. 4*a* and FIG. 4*b* show the method, according to the invention, as functional diagram and flow/sequence diagram.
Figure 4B:
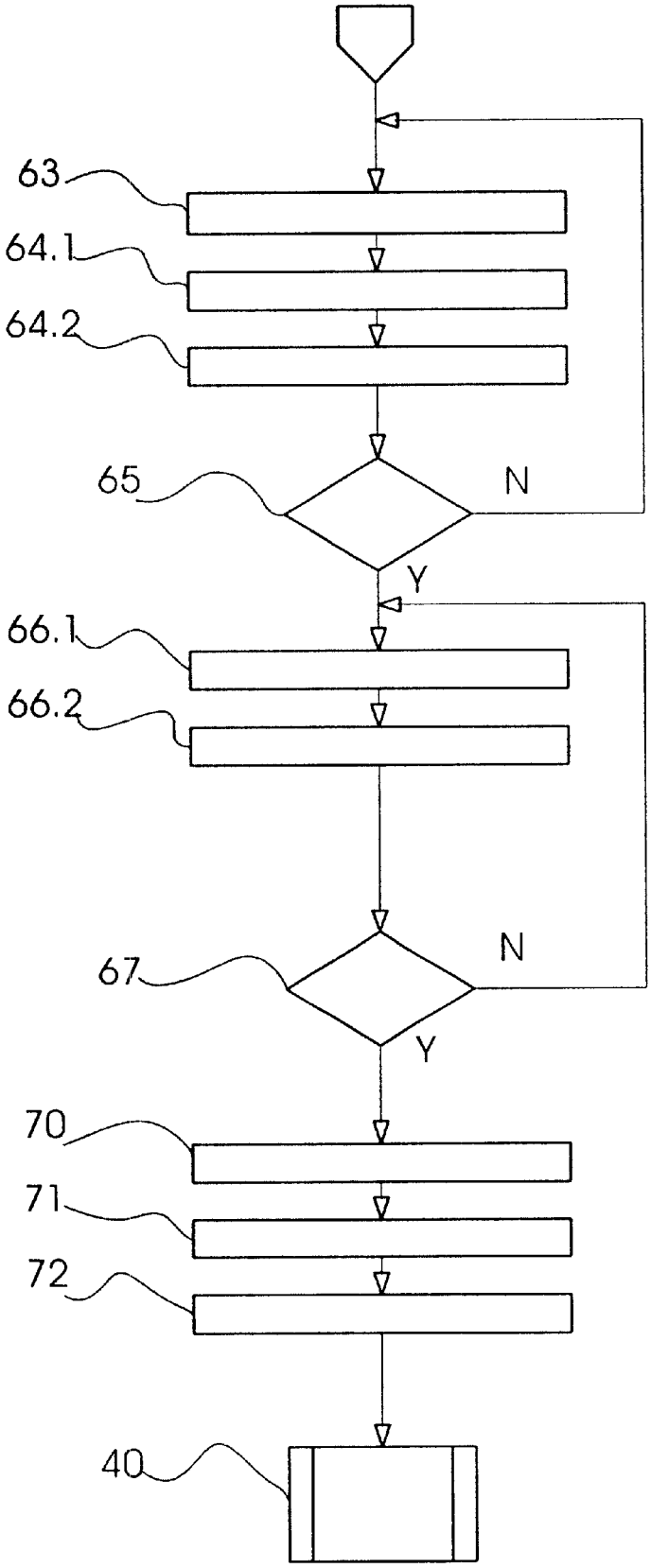
Figure 5:
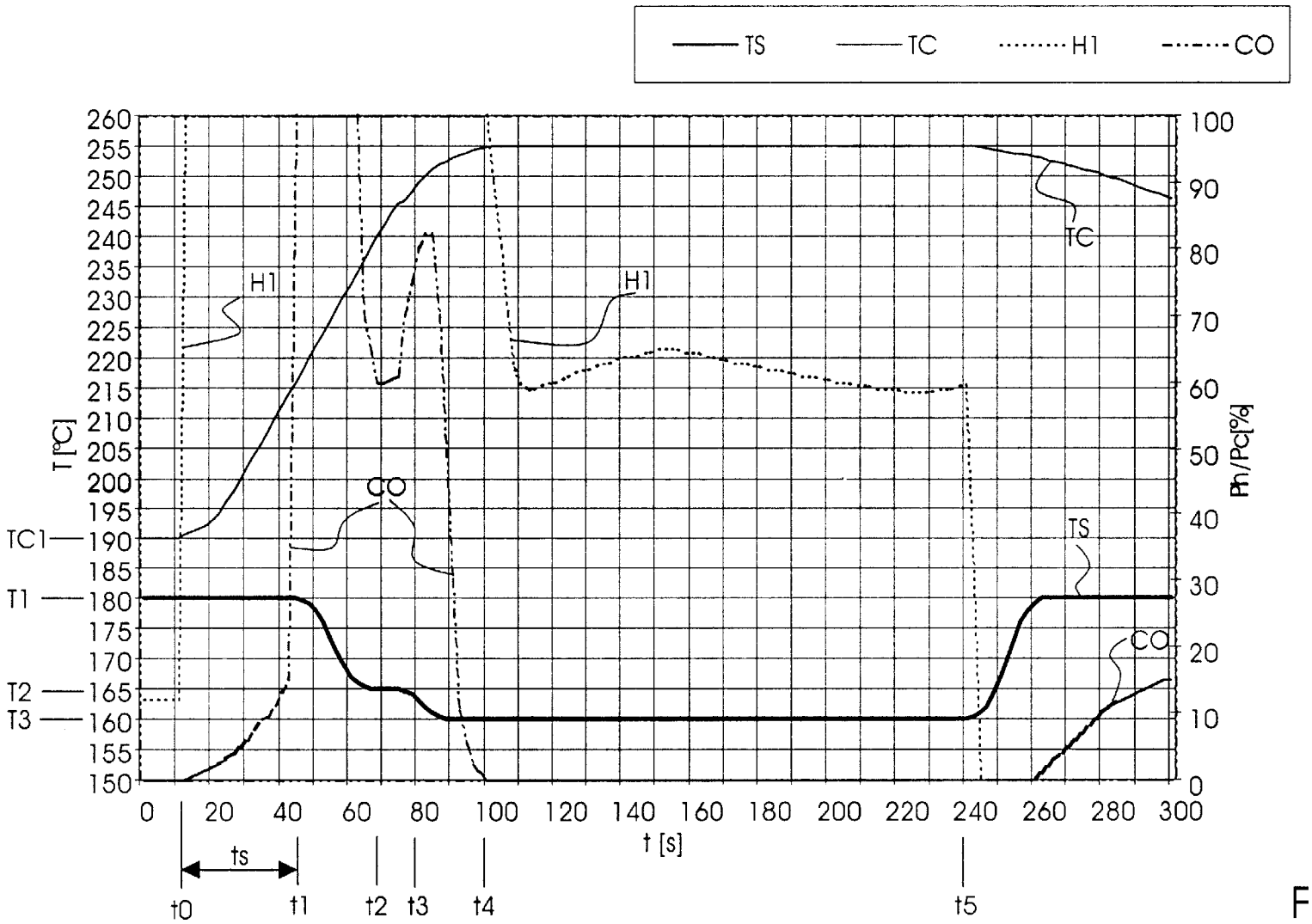
FIG. 5 shows the method from FIG. 4, according to the invention, as temperature/time diagram of the fixing roller and as heating level/time diagram of the heating unit and the compressed air unit.

The mode of operation of the device is as follows and can be characterized through the following steps, respectively indicated by reference numbers on the flowchart according to FIG. 4*a* and FIG. 4*b* as well as on the temperature/performance time chart in FIG. 5:

Proceeding from an initial stable operational state "Wait" W of the fixing unit (corresponding to the above mentioned mode of action and the flowchart in FIG. 4*a*, Step 40, as well as in FIG. 5), the pressing roller PR, along with the oil/cleaning roller (not shown) has separated or has risen off the rotating fixing roller FR. The temperature Ts on the outer surface FS of the fixing roller FR shows its first temperature value T1, which is adjusted to T1=180–181° C. with the heating unit H1 of the fixing roller FR working with 10–15% of its heating capacity (Step 41) and through the blowing airflow AJ, AJ1–3 of the cooling unit CO (reference number 42). The first switch to operational state A is undertaken (reference number 50) and with that the "Request and preparation for a new/first fixing task" operational state is started by a serviceperson, respectively by a control program of the copy machine at time point to=11 s, as shown in FIG. 5.

After the start, respectively after the switching over (Step 50) from the first operational state W to the second operational state A of the Fixing unit, the fist predetermined temperature value T1 of the fixing roller FR is generated and adjusted with the heating unit H1 being maintained at a constant maximal heating level Ph (Step 51). After reaching the predetermined first temperature value T1, this temperature value is regenerated and readjusted by a blowing airflow AJ of the cooling unit CO driven by small through mid (0 to 50%) airflow level Pc (Step 53).

Then, after a time interval/time span ts of the time-clock unit (FIG. 4*a*, Steps 56, 58–61.2, and FIG. 5), a second predetermined and lower temperature value T2=165° C. of the fixing roller FR is generated. This lower temperature is adjusted for in the third operational state (F) of the fixing roller at further constant maximal heating level Ph by a maximal (100%) to mid (around 50%) airflow level Pc driven blowing airflow AJ, AJ 1–3.

The time between the start of the second operational state A "Request/preparation for a fixing task" and the switching over to the third operational state F "Fixing"—around at the time point t2=70 s (FIG. 5), is determined by the time interval/time span ts=t1–t2 (FIG. 5) generated by the time—clock unit. The duration depends on the operational mode of the fixing unit before the request of the fixing task, and particularly on the core temperature T1 of the fixing roller FR, before the request of the fixing task, as well as on the first operational state W "Wait" and the type of the imaging material P carrying the toner image.

After the second predetermined temperature value T2 in the third operational state F "Fixing" (Step 62) has been reached, a third predetermined temperature value T3=160–161° C. of the fixing roller FR is generated by placing/moving the pressing roller PR onto the fixing roller FR (Step 63) around the time point t3=80 s (FIG. 5). This third temperature value is adjusted to the second lower temperature value T3 (FIG. 4*b*, Steps 65–66.2) by adjusted heating level Ph of the heating unit H1 and through adjusted air level Pc of the blowing airflow AJ, AJ1–3 since reaching substantially 100% of the core temperature Tc of the fixing roller FR around the time point t4=100 s (FIG. 5) and actually till the end of the fixing task, around the time point t5.

The generation and adjustment of the predetermined temperature values T1, T2, and T3 on the outer surface FS of the fixing roller FR is completed by the controllable and adjustable blowing airflow AJ, AJ1–3 of the cooling unit, whereby the control and the adjustment of the blowing airflow AJ, AJ1–3 is performed also depending on the obtained core temperature Tc of the fixing roller FR.

The placing/moving of the pressing roller PR (FIG. 4*b*, Step 63) takes place at a time point t3 (FIG. 5), which depends on the obtained time interval/time span ts for switching over to operational state F "Fixing", whereby the core temperature Tc of the fixing roller FR amounts to about 90% and the forwards end of the first imaging material P is fed into the fixing nip N. The start of the introduction of the imaging material P through the fixing nip N depends on, or is determined by the obtained time interval/time span.

During the operational states A and F, "Request if a fixing task" and "Fixing", the core temperature Tc of the fixing roller FR is determined by and is obtained from the switching time interval t and the heating level Ph of the heating unit H1 using specific values of the fixing roller, such as thermal capacity and thermal conductivity, as well as from the core temperature Tc1 (FIG. 5) of the fixing roller FR before the request of fixing task. Both gradients (adjustment values according to Steps 52 and 57 (FIG. 4)) are built depending on the obtained core temperatures Tc (FIG. 5) of the fixing roller in such a way that the adjustment of the blowing airflow AJ, AJ1–3 becomes possible depending on the temperature deviations on the outer surface FS of the fixing roller FR after taking into account the obtained core temperature Tc.

The invention has been described in detail with particular reference to certain preferred embodiment thereof, but it will be understood that variations and modifications can be effected within the spirit and scope of the invention.

Parts List

A Operational state "Request/preparation for a fixing task"

F Operational state "Fixing"

W Operational state "Wait"

AG1 First air conducting element at the blowing air unit (cooling unit)

AG2 Second air conducting element at the fixing roller (cooling unit)

AJ Blowing airflow of the blowing air unit (cooling unit)

AJ1 Blowing airflow of the first blowing air unit (alternative cooling unit)

AJ2 Blowing airflow of the second blowing air unit (alternative cooling unit)

AJ3 Blowing airflow of the third blowing air unit (alternative cooling unit)

AP Air channel between the blowing air unit and the source of compressed air (cooling unit)

AP1 Air channel between the first blowing air unit and the source of compressed air (alternative cooling unit)

AP2 Air channel between the second blowing air unit and the source of compressed air (alternative cooling unit)

AP3 Air channel between the third blowing air unit and the source of compressed air (alternative cooling unit)

AT Blowing air unit (air pipe) of the alternative cooling unit

AT1 First blowing air unit (air pipe) of the cooling unit

AT2 Second blowing air unit (air pipe) of the alternative cooling unit

AT3 Third blowing air unit (air pipe) of the alternative cooling unit

AS Compressed air compressor (compressed air source of the alternative cooling unit)

BL Compressed air source of the cooling unit

CA Cooling strip on the outer surface of the fixing roller

CA1 First cooling strip on the outer surface of the fixing roller (alternative cooling unit)

CA2 Second cooling strip on the outer surface of the fixing roller (alternative cooling unit)

CA3 Third cooling strip on the outer surface of the fixing roller (alternative cooling unit)

CO Cooling unit

CP Microprocessor unit

CP/I Input switching circuit of the Microprocessor unit

CP/O Output switching circuit of the Microprocessor unit

CU Control/Adjustment

D Air nozzle at the blowing air unit (cooling unit)

D1 First air nozzle at the blowing air unit (alternative cooling unit)

D2 Second air nozzle at the blowing air unit (alternative cooling unit)

D3 Third air nozzle at the blowing air unit (alternative cooling unit)

H1 Heating unit of the fixing roller

H2 Heating unit of the pressing roller

FR Fixing roller

FC Core/internal circumference surface of the fixing roller

FS Outer surface of the fixing roller

N Fixing opening of the fixing agent/fixing roller of the fixing unit

P Imaging medium/sheet (paper, foil, etc.) carrying the toner image

PR Pressing roller

PV Controllable air valve at the blowing air unit (alternative cooling unit)

Pc Cooling level of the blowing airflow (cooling unit)

Ph Heating level of the heating unit of the fixing roller

RS Semniconductor relay for the heating unit

RC Device for setting up the number of revolutions of the motor of the ventilator of the cooling unit ST Temperature sensor on the outer surface of the fixing roller T1 First temperature value (180° C.) on the outer surface of the fixing roller in operational state "Wait"

T2 Second temperature value (165° C.) on the outer surface of the fixing roller in operational state "Request/preparation for a fixing task"

T3 Third temperature value (160° C.) on the outer surface of the fixing roller in operational state "Fixing"

Ts Temperature on the outer surface of the fixing roller

Tc Temperature on the core/internal circumference surface of the fixing roller ts Time interval/time span of the time-clock unit (depending on the type of the imaging material/paper and the core-temperature of the fixing roller before operational state A)

to Starting time point of operational state A t1 Time point after the time interval/time span and for gradient building t2 Time point at which the preparation of the fixing task has been completed and the second temperature value T2=165° C. has been reached, and the transport of the imaging material/paper has begun t3 Time point at which the forward edge of the first sheet has reached the fixing opening and at which the pressing roller has been placed over the fixing roller t4 Time point at which the core temperature of the fixing roller has reached 100% and at which the adjustment of the heating level and the adjustment of the air level have got active together t5 Time point at which the last sheet of the fixing task leaves the fixing opening and at which the pressing roller moves away from the fixing roller X Supported direction of the imaging material carrying the toner image

40. Fixing roller/fixing unit are in operational state "W"

41. Fixing roller/outer surface is adjusted to T1=180° C. by means of the heating unit

42. Fixing roller/outer surface is adjusted to T1=181° C. by means of the cooling unit

50. A new fixing task has been requested & task preparation/operational state "A"

51. The heating unit of the fixing roller has been switched to constant 100%

52. Build the first gradient for adjustment of the blowing airflow as function of the core temperature

53. Adjust the fixing roller with the cooling unit to T1=180° C.

54. Start the time-clock unit; build the time interval/time span depending on the paper type and the core temperature

55. The time point at the end of the time interval/time span has been reached

56. The heating unit of the fixing roller has been switched to constant 100%

57. Build the second gradient for adjustment of the blowing airflow as function of the core temperature

58. Adjust the fixing roller with the cooling unit to T2=165° C.

59. The temperature value of the fixing roller has reached T2=165° C.

60. Start of the sheet transport of fixing task/operational state "F"

61.1 The heating unit of the fixing roller has been switched to constant 100%

61.2 Adjust the fixing roller with the cooling unit to T2=165° C.

62. First sheet with its forward edge in the fixing opening (Core temperature around 90%)

63. Place/move the pressing roller on the fixing roller

64.1 The heating unit of the fixing roller has been switched to constant 100%

64.2 Adjust the fixing roller with the cooling unit to T=160° C.

65. 100% core temperature at the fixing roller reached

66.1 Adjust the fixing roller with the heating unit to T3=160° C.

66.2 Adjust the fixing roller with the cooling unit to T3=161° C.

67. Fixing task ended?

70. Adjust the fixing roller with the heating unit to T3=180° C.

71. Adjust the fixing roller with the cooling unit to T3=181° C.

72. Take off/move out the pressing roller from the fixing roller

What is claimed is:

1. A device for generation and adjustment of predetermined temperature values (T1, T2, and T3) at a fixing roller (FR) of a fixing unit, which is mounted in a copy machine and can be switched over to different operational states (W, A, F) for fixing imaging material (P) carrying toner images, whereby the fixing roller, which can rotate, along with a pressure roller (PR) parallel to the axis of the fixing roller and in contact with its outer surface (FS) provide a fixing nip (N) for feeding through imaging material carrying toner images; said device comprising: a heating unit (H1) for said fixing roller, said heating unit, connected to a control/adjustment unit (CU), can be switched for generation and adjustment of predetermined temperature values (T1, T2, and T3) and its heating level (Ph) can be adjusted; at least one temperature sensor (ST) for sensing the predetermined temperature values (T1, T2, and T3) on the outer surface (FS) of the fixing roller; and a blowing airflow (AJ, AJ1–3) fed by a controllable cooling unit (CO) for cooling the outer surface of the fixing roller; said cooling unit (CO) having at least one blowing air unit (AT, AT1–3) in the form of a pipe and connected to a compressed air source (BL, AS), whereby the blowing air unit (BL, AS) is mounted in a stationary manner axially parallel to the fixing roller (FR) and radially at a distance from its outer surface (FS), and located, in relation to the supported direction (X) of the imaging medium (P) carrying the toner image in the direction of the airflow towards the fixing nip (N), at a distance from this fixing nip said at least one blowing air unit providing a focused and concentrated blowing airflow (AJ, AJ1–3) to create a cooling strip (SA, SA1–3) on the outer surface of the fixing roller, the width of the whole cooling strip generated from the cooling strip (CA, CA1–3) of the blowing air unit (AT, AT1–3) being a substantially equal or less than one-fourth of the outer surface of the fixing roller (FR), whereby its airflow level (Pc) can be controlled and adjusted by said control/adjustment unit (CU) acting upon the compressed air source (BL, AS), wherein a first predetermined temperature value (T1) of the fixing roller (FR) is generated and adjusted by the heating unit (H1) run at constant maximal heating level (Ph), and after reaching the first temperature value of the blowing airflow (AJ, AJ1–3) of the cooling unit (CO) driven by small to mid (0 to 50%) airflow level (Pc), it switches over from a first (W) to a second (A) operational state of the fixing unit, and a predetermined lower temperature value (T2) of the fixing roller (FR) at further constant heating level (Ph) is generated and adjusted into a third operational state (F) of the fixing unit by blowing airflow (AJ, AJ1–3), which is run at maximal (100%) to mid (about 50%) airflow level (Pc).

2. Device according to claim 1, wherein operational states (A and F) "Request for a fixing task" and "Fixing", and the core temperature (Tc) of the fixing roller (FR) is determined and obtained from the switching time (t) and the heating level (Ph) of the heating unit (H1), from specific characteristic values of the fixing roller, as well as from the core temperature (Tc1) of the fixing roller (FR) before the request for a fixing task (A); and a gradient is built depending on the obtained core temperature (Tc) of the fixing roller (FR), which allows the adjustment of the blowing airflow (AJ, AJ1–3) depending on the temperature deviation at the outer surface (FS) of the fixing roller (FR) while taking into account the obtained core temperature (Tc).

3. Device according to claim 1, wherein said cooling unit (CO) has three blowing air units (AT1, AT2, and AT3) arranged one behind the other in the direction of rotation of the fixing roller (FR), which blowing units are positioned parallel to each other and in a concentric layout in relation to the fixing roller; and the three blowing air units (AT1, AT2, and AT3) are mounted in the direction of rotation and at such an angular distance from each other that the cooling strips (CA1, CA2, and CA3) formed through their blowing airflows (AJ1, AJ2, and AJ3) at the outer surface (FS) of the fixing roller (FR) are either at a distance from each other, or are touching one another.

4. Device according to claim 3, wherein said blowing air unit (AT, AT1–3) has in its pipe at least one air nozzle (D, D1–3) in the form of a slot, which extends along its axial length and is used for generation of concentrated and focused blowing airflow (AJ, AJ1–3), by which said cooling strip (CA, CA1–3) with predetermined width and extending along the whole axial length of the fixing roller can be generated at the outer surface (FS) of the fixing roller (FR).

5. Device according to claim 3, wherein said blowing air unit (AT, AT1–3) was in its pipe a number of air nozzles (D, D1–3) arranged along its axial length for generation of concentrated and focused blowing airflow, by which said cooling strip) (CA, CA1–3) with predetermined width and extending along the whole axial length of the fixing roller can be generated at the outer surface (FS) of the fixing roller (FR).

6. Device according to claim 5, wherein said air nozzles (D, D1–3) of the blowing air unit (AT, AT1–3) along the axial length of the fixing roller (FR) have different predetermined diameters, forms, or different distances from one another in such a way that an inhomogeneous warming of the fixing roller along its axial length can be prevented by predetermined balancing cooling.

7. Device according to claim 1, wherein said blowing air unit (AT1, AT1–3) is in the form of a cylindrical pipe with circular cross-section profile whose first axial end is hermetically closed and its second end is connected with the compressed air source (BL, AS).

8. Device according to claim 1, wherein said compressed air source of the cooling unit (CO) is a motor-drive ventilator; the blowing air units (AT, AT1–3) are connected with the ventilator by air channels (AP, AP1–3); and air valves controlled individually or all together by said control/adjustment unit (CU), control and adjust the blowing airflow (AJ, AJ1–3) of the blowing air unit.

9. Device according to claim 1, wherein said compressed air source of the cooling unit (CO) is a motor-driven ventilator; the blowing units (AT, AT1–3) are connected by air channels (AP, AP1–3) with the ventilator; and the blowing airflow (AJ, AJ1–3) of the blowing air unit can be controlled and regulated through changes in the number of revolutions of the ventilator, which can be effected by the control/adjustment unit (CU) and a unit for setting the number of revolutions.

10. Device according to claim 1, wherein said cooling unit (CO) has at its blowing air unit (AT, AT1–3) a blowing airflow (AJ, AJ1–3) with air over-pressure equal or less than 1.5 bar and with air level (Pc) equal or less than 16 liter/sec.

11. Device according to claim 1, wherein said at least one temperature sensor (ST) for measurement of the temperature values (TS, T1, T2, and T3) on the outer surface (FS) of the rotating fixing roller (FR) is mounted in the direction of the airflow (downstream) in relation to the supported direction (X) of the imaging material (P) carrying toner images between the blowing air unit(s) (AT, AT 1–3) and the fixing nip (N); and the temperature sensor (ST) stays in contact with the outer surface (FS) of the fixing roller (FR) or measures the temperature values (TS, T1–3) without entering in contact with and staying at a distance from the outer surface.

* * * * *